United States Patent [19]

Ratcliff

[11] Patent Number: 5,044,122

[45] Date of Patent: Sep. 3, 1991

[54] METHOD AND APPARATUS FOR BEVELING AN INSIDE EDGE OF A GLASS ARTICLE

[75] Inventor: Meredith D. Ratcliff, Circleville, Ohio

[73] Assignee: Thomson Consumer Electronics, Inc., Indianapolis, Ind.

[21] Appl. No.: 636,462

[22] Filed: Dec. 31, 1990

[51] Int. Cl.[5] ..... B24B 7/00; B24B 9/00

[52] U.S. Cl. ..... 51/55; 51/124 R; 51/165.79; 51/227 R; 51/283 R

[58] Field of Search ..... 51/109 R, 119, 124 R, 51/127, 55, 100 R, 101 R, 125, 165.79, 165.89, 281 SF, 283 R, 283 E, 227 R

[56] References Cited

U.S. PATENT DOCUMENTS

| | | | |
|---|---|---|---|
| 3,381,347 | 5/1968 | Reinwall | 29/25.13 |
| 3,456,398 | 7/1969 | Gingrich | 51/227 |
| 3,500,591 | 3/1970 | Gawronski et al. | 51/263 |
| 3,550,322 | 12/1970 | Rajnik et al. | 51/89 |
| 3,641,712 | 2/1972 | Menzel | 51/122 |
| 3,833,230 | 9/1974 | Noll | 51/235 X |
| 3,858,363 | 1/1975 | Noll et al. | 51/105 R |
| 4,038,785 | 8/1977 | Scott | 51/145 R |
| 4,718,203 | 1/1988 | Schweltz et al. | 51/227 R X |
| 4,760,671 | 8/1988 | Ward | 51/3 X |

*Primary Examiner*—Margarita Rachuba
*Assistant Examiner*—John A. Marlott
*Attorney, Agent, or Firm*—Joseph S. Tripoli; Dennis H. Irlbeck; Vincent J. Coughlin, Jr.

[57] ABSTRACT

A method for uniformly beveling an inside edge of a glass article having an opening at one end thereof includes the steps of: providing a plate having a peripheral shape generally corresponding to that defined by the edge of the glass article, the plate having a beveled edge containing an abrasive material; supporting the glass article so that its inside edge is in proximity to the beveled edge of the plate; and establishing contact between the glass article and the abrasive material. An orbital, undulatory motion is induced between the bevel plate and the glass article to abrade at least a portion of the inside edge of the glass article. An apparatus for practicing the method is also described and may be used for uniformly beveling the inside edge of CRT funnels and faceplate panels.

4 Claims, 5 Drawing Sheets

98
76
80
84
68
138
82
70
78
72
100
86
104
44
114
96
94
40
140
110
128
118
134
132
92
66
B
B'
A
A'
90
62
94
120
126
130
122
96
108
116
102
106
124
88
112
136
74

METHOD AND APPARATUS FOR BEVELING AN INSIDE EDGE OF A GLASS ARTICLE

This invention relates to a novel method and apparatus for beveling an inside edge of a glass article and, more particularly, to a method and apparatus for beveling the inside seal edge of a glass funnel or faceplate for a cathode-ray tube.

BACKGROUND OF THE INVENTION

A cathode-ray tube, such as a color television picture tube, comprises an evacuated glass envelope which includes a funnel, having a substantially rectangular opening at one end and a tubular neck at the other end, and a faceplate panel that is sealed to the one end of the funnel by a frit seal. It is common practice to bevel the sharp inside edges of the sealing surfaces of the funnel and panel to prevent chipping or bruise checking which can cause either particles within the tube or a failure of the evacuated tube.

U.S Pat. No. 3,550,322, issued to Rajnik et al. on Dec. 29, 1970, discloses an edge beveler which permits power grinding of the inside and outside seal edges of the funnel and faceplate panel. The edge beveler includes a vertical rotatable shaft having a plate member at the upper end thereof which has a peripheral shape generally corresponding to that defined by the seal edge of the article to be beveled. The plate member is smaller than the inner border of the seal edge and is located within the article. A plurality of rollers support the seal edge of the article while it is rotated by the vertical shaft. A pair of motor driven grinding wheels contact, at an angle, the inner and outer borders of the sealing edge of the article.

A drawback of the above-described edge beveler is that the sides of the substantially rectangular funnel and panel have very large radii of curvature whereas the curvature of the corners is small and it is therefore difficult to obtain a uniform bevel around the entire periphery of the seal edge. Additionally, the diameter of the grinding wheels must be small enough to accommodate the corners of the funnel and panel so the grinding wheels must be replaced frequently. Also, the same area on each of the grinding wheels contacts the borders of the seal edge further accelerating wear of the grinding wheels.

A need therefore exists for a method and apparatus of beveling an edge which minimizes the drawbacks of the prior art.

SUMMARY OF THE INVENTION

A method for uniformly beveling an inside edge of a glass article having an opening at one end thereof includes the steps of: providing a plate having a peripheral shape generally corresponding to that defined by the edge of the glass article, the plate having a beveled edge containing an abrasive material; supporting the glass article so that its inside edge is in proximity to the beveled edge of the plate; and establishing contact between the glass article and the abrasive material. An orbital, undulatory motion is induced between the bevel plate and the glass article to abrade at least a portion of the inside edge of the glass article.

DETAILED DESCRIPTION OF THE PREFERRED EMBODIMENTS

Figure 1:
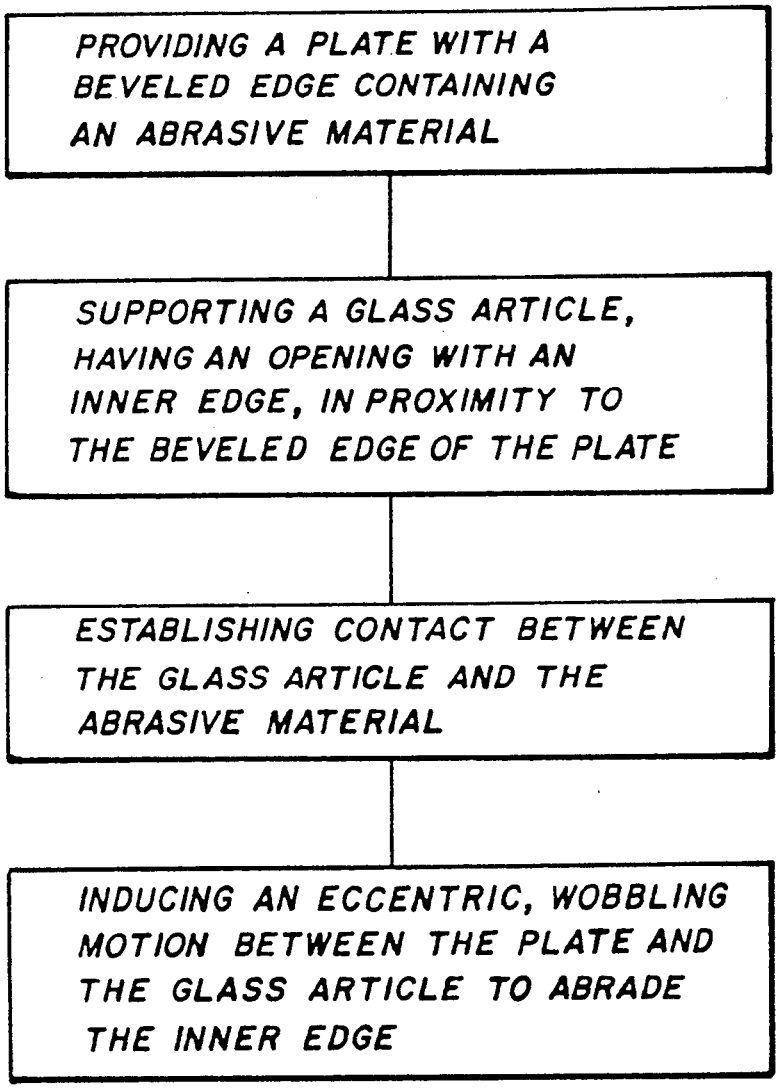
FIG. 1 is a flow diagram of the novel method.

FIG. 1 is a flow diagram of the novel method. The novel method applies to beveling the inside seal edge of a glass article having an opening at one end thereof, such as the funnel or the faceplate panel of a color-television picture tube. Unlike prior methods which utilize grinding wheels, the present method utilizes a plate having a beveled edge which contains a suitable abrasive material that contacts and abrades the inside portion of the seal edge. The glass article is supported in proximity to the beveled edge of the plate and contact is established therebetween. An orbital, undulatory motion between the plate and the glass article is induced and causes the abrasive material to abrade the inside edge of the glass article to produce a uniform bevel.

The method is performed by the apparatus shown in FIGS. 2-5. Similar reference characters refer to similar parts in each of the figures of the drawings.

Figure 2:
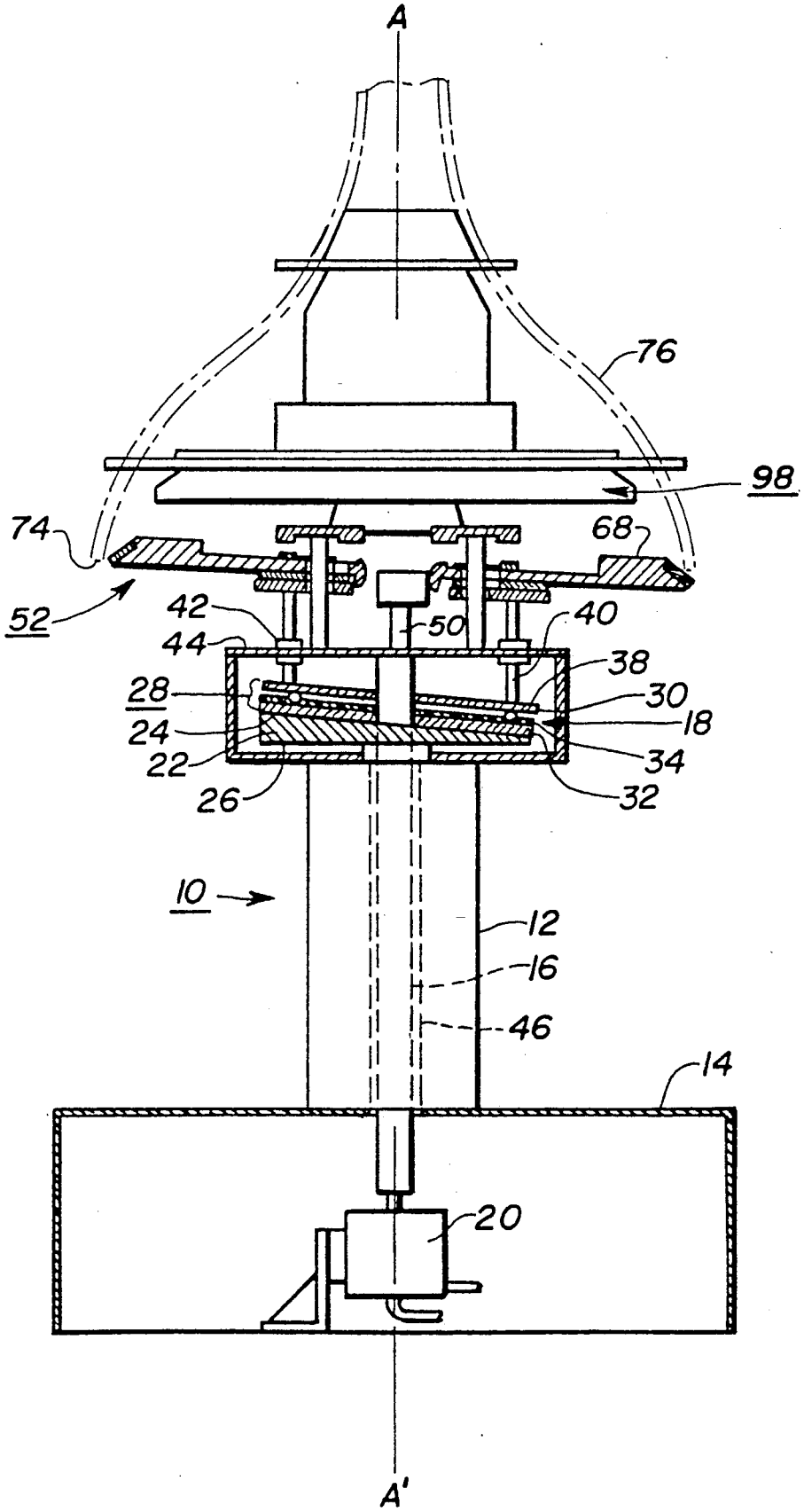
FIG. 2 is a plan view, partially in axial section, of one of a novel apparatus according to the present invention.
Figure 3:
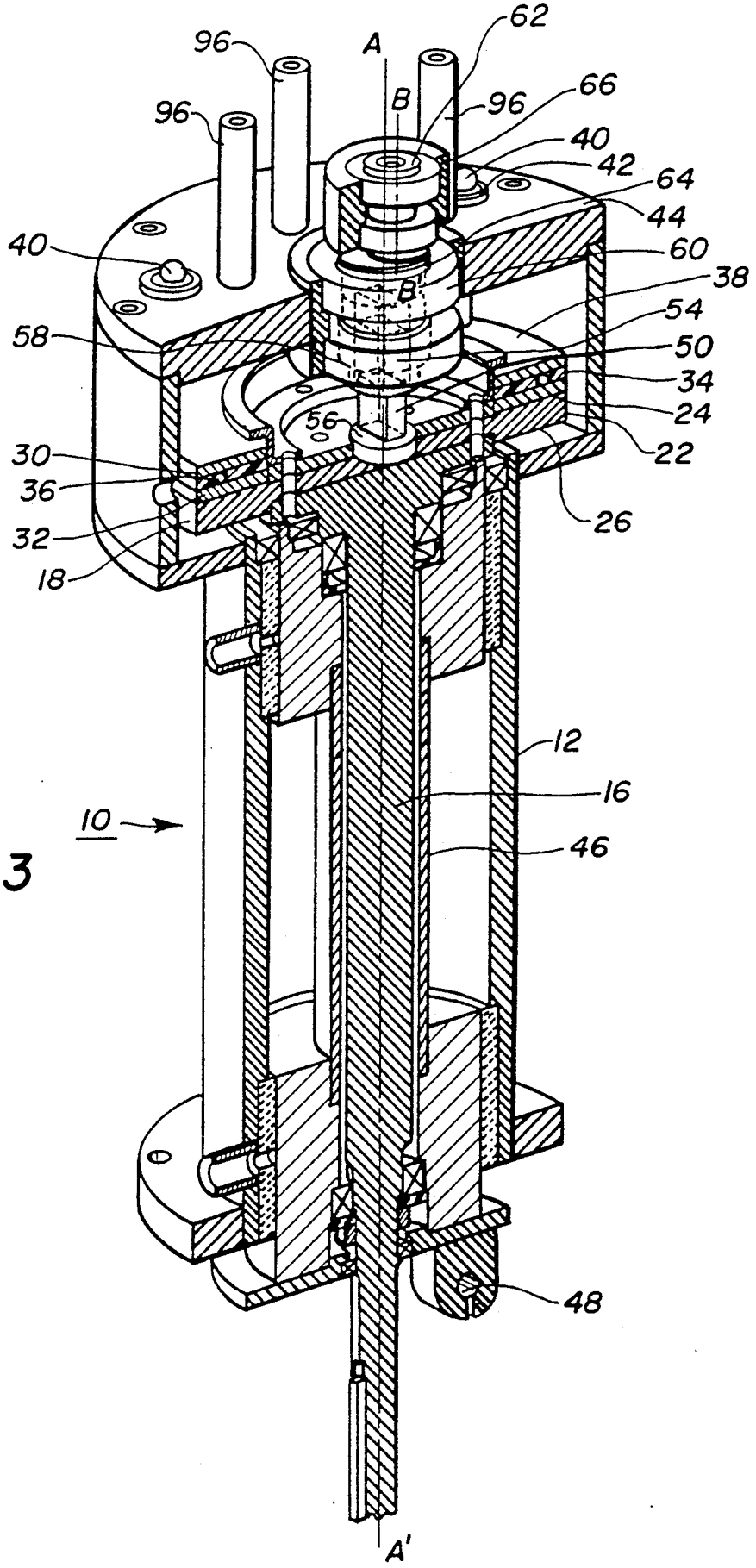
FIG. 3 is an enlarged sectional view of a portion of the apparatus of FIG. 2.
Figure 4:
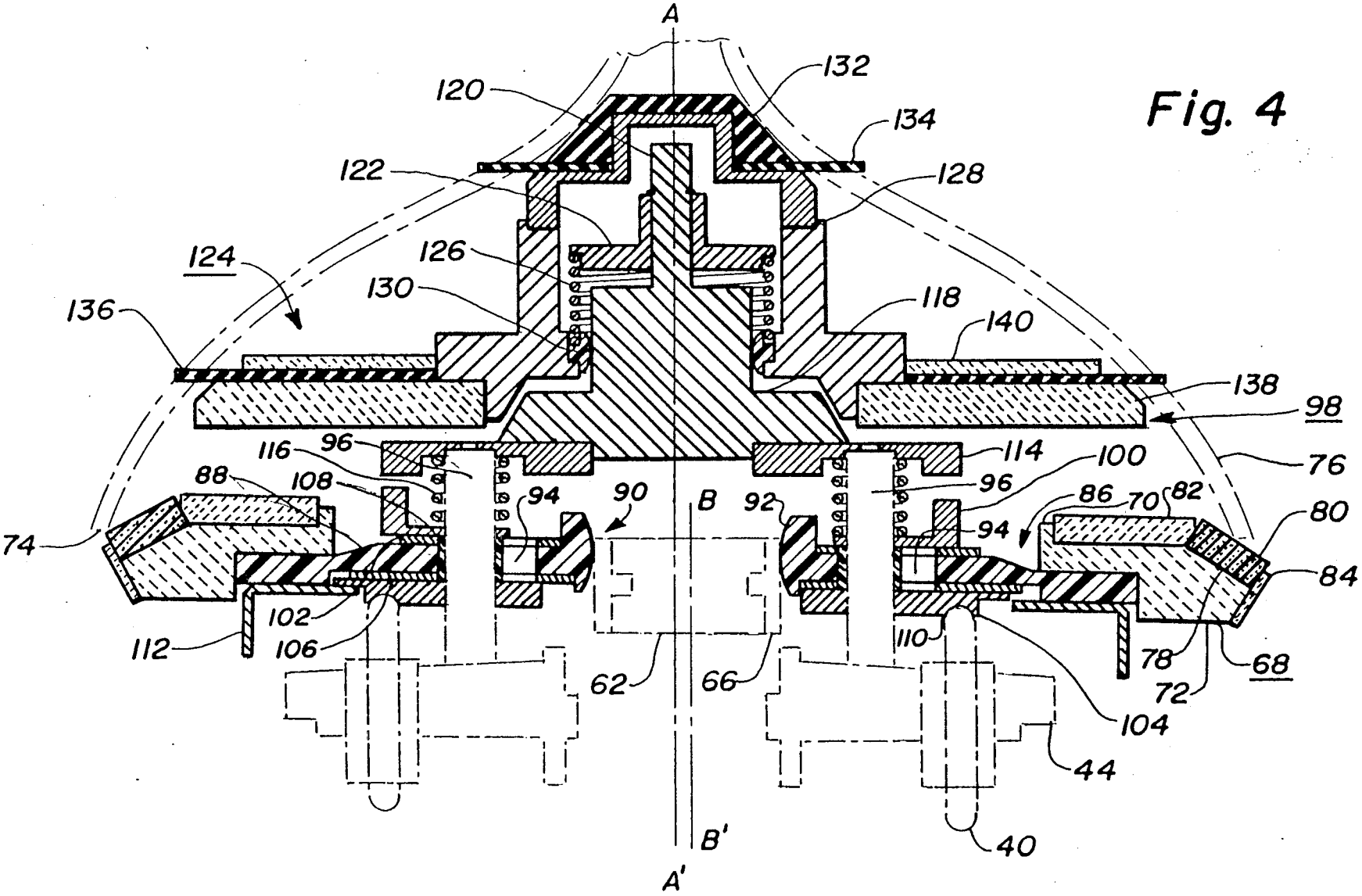
FIG. 4 is an enlarged sectional view of another portion of apparatus of FIG. 2.

Referring to FIGS. 2-4, the novel apparatus comprises a vertical column assembly 10 having an outer housing 12 which is supported on a base 14. A primary rotatable shaft 16 is disposed within the housing 12 and is attached at one end to a first plate assembly 18 and at the other end to a motor 20. The first plate assembly 18 includes a wobble plate 22 having a first major surface 24 and an oppositely disposed second major surface 26. The first major surface 24 is inclined at an acute angle of about 1° relative to the second major surface 26. A bearing assembly 28 rests on the first major surface 24 of the wobble plate 22. The bearing assembly comprises a first annular bearing race 30 and a second annular bearing race 32 spaced from the first bearing race by a bearing retainer 34 having a plurality of ball bearings 36 located therein. The first annular bearing race 30 has a contact surface 38 which acts as a wear plate for a plurality of wobble pins 40 each of which is disposed within a separate bronze bushing 42 extending through a top cap 44 of the outer housing 12. Preferably, six wobble pins 40 are radially disposed around the top cap at intervals of about 60°.

The primary shaft 16 is mounted within a cartridge 46 which is slideably disposed within the outer housing 12. A pivot point 48, is affixed to the lower surface of the cartridge 46 and provides a means for raising and lowering the primary shaft. The cartridge 46 and the primary shaft 16 are shown in the lowered position in FIG. 3.

Again with reference to FIG. 3, a secondary rotatable shaft 50 is disposed between the first plate assembly 18 and a second plate assembly 52 (shown in FIGS. 2 and 4). The secondary shaft 50 has a distal end 54 and a proximal end 56 which is disposed on the wobble plate 22 and, thus, in communication with the primary shaft 16. The primary shaft 16 and the secondary shaft 50 are coaxial, i.e., each has a common longitudinal axis A—A aligned along the longitudinal axis of the column assembly 10. The distal end 54 of the secondary 50 fits within a keyway 58 formed within a top bearing 60 centrally located within the top cap 44. A cam 62 is attached to a top surface 64 of the bearing 60 so that the movement of the cam is eccentric or orbital relative to the rotation of the secondary shaft 50, i.e., the longitudinal axis, B—B', of the cam 62 is laterally displaced relative to the longitudinal axis, A—A', of the primary shaft 16 and the secondary shaft 50. An eccentric hub 66 circumscribes the cam 62.

The second plate assembly 52 includes a bevel plate 68 having a first major surface 70 and an oppositely disposed second major surface 72. The bevel plate is substantially rectangular and generally corresponds to that defined by a seal edge 74 of a glass article, such as a funnel, 76 shown in phantom in FIGS. 2 and 4. The first major surface 70 of the bevel plate 68 has dimensions smaller than those of the seal edge 74 of the funnel and the second major surface 72 has dimensions that are larger than the seal edge. A beveled edge 78 is contiguous with the first major surface 70 and provides a support for an abrasive material 80. Preferably, the abrasive material is a diamond lap material attached to a resilient backing which is attached to the beveled edge 78 by a suitable adhesive and/or retained thereagainst by a top retainer 82 and an edge retainer 84. A centrally disposed bevel plate aperture 86 is formed through the bevel plate. An annular bevel plate support 88 is affixed to the second major surface 72 of the bevel plate 68. The bevel plate support 88 has a central aperture 90 circumscribed by a rim 92 which surrounds the eccentric hub 66 on the cam 62. A plurality of openings 94, for example six openings, are formed through the body of the bevel plate support 88 to accommodate a plurality of standoffs 96 which extend from the top cap 44 to a vacuum chuck assembly 98 which supports and aligns the funnel 76 so as to locate it against the bevel plate 68. A spring plate 100 is disposed in spaced relation to the top of the bevel plate support 88 with an upper slide plate 102 disposed therebetween. A wear plate 104 is disposed in spaced relation to the bottom of the bevel plate support 88 and a lower slide plate 106 is located therebetween. A spacer 108 is disposed in each of the openings 94 between the spring plate 100 and the wear plate 104. A groove 110 is formed in the bottom surface of the wear plate 104 to accommodate the wobble pins 40. A splash ring 112 is attached to the bottom surface of the bevel plate support 88 to prevent the accumulation of debris from the beveling operation on the moving parts of the apparatus.

The vacuum chuck assembly 98 includes a chuck mounting plate 114 to which the standoffs 96 are attached. A spring 116 surrounds at least a portion of each of the stantoffs 96. The springs 116 extend between the spring plate 100 of the second plate assembly 52 and the mounting plate 114. A centrally disposed support 118 having a post 120 projecting from one end there is affixed to the mounting plate 114. A spring retainer 122 encircles the post 120 and is attached thereto. A vacuum seal assembly 124 is connected to the spring retainer 122 by a support spring 126. The vacuum seal assembly 124 includes a seal support cap 128 which encloses a portion of the support 118. An inwardly directed annular guide 130 (preferably made of nylon) slidingly contacts a portion of the support 118 and provides a lower support for the support spring 126. A resilient plug 132 secures a first annular vacuum seal 134 across the throat of the funnel 76. A second annular vacuum seal 136 is spaced from the first seal 134 and closes an intermediate portion of the funnel. A second annular seal support plate 138, having a diameter less than that of the annular seal 134, is attached to the seal support cap 128 and provides a lower support for the annular seal 134. An annular seal retainer plate 140 is spaced from the support plate 138 and connected to the support cap 128, and provides an upper support for the second annular seal 136. A vacuum is established in the volume between the vacuum seals 134, 136 and the funnel 76 by a conventional vacuum line, not shown, which extends through the annular seal support plate 138, the annular seal 134, and the annular seal retainer plate 140. The vacuum holds the funnel 76 during the beveling operation. The support spring 126 provides pressure between the funnel 76 and the abrasive material 80 on the beveled edge 78 of the bevel plate 68.

When the motor 20 is energized to rotate the primary and secondary shafts 16 and 50, the cam 62 within the eccentric hub 66, that is disposed in the central aperture 90 of the bevel plate support 88, causes the second plate assembly 52 to move, orbitally, in a plane transverse to the longitudinal axis A—A' of the vertical column assembly 10. When the cartridge 46 is raised by the pivot point 48, the wobble pins 40, resting on the contact surface 38 of the first bearing race 30, are raised to contact the groove 110 of the wear plate 104 attached to the bottom of bevel plate support 88. The bevel plate 68 with its abrasive 80 is thereby brought into contact with the seal edge 74 of the funnel 76. As the wobble plate 22 rotates, the wobble pins 40 move up and down against the wear plate 104 and to provide an undulatory motion to the spring-biased second, or bevel, plate assembly 52. The resulting orbital, oscillatory motion between the abrasive material 80 on the edge 78 of the bevel plate 68 and the inside seal edge of the funnel 76 is sufficient to uniformly remove about 0.25 to 0.50 mm of glass to provide a bevel which resists chipping and bruise checking of the glass. Preferably, the bevel is formed at an angle of about 45°. A fluid, such as water, is applied to the abrasive material 80 to remove the grinding debris.

Figure 5:
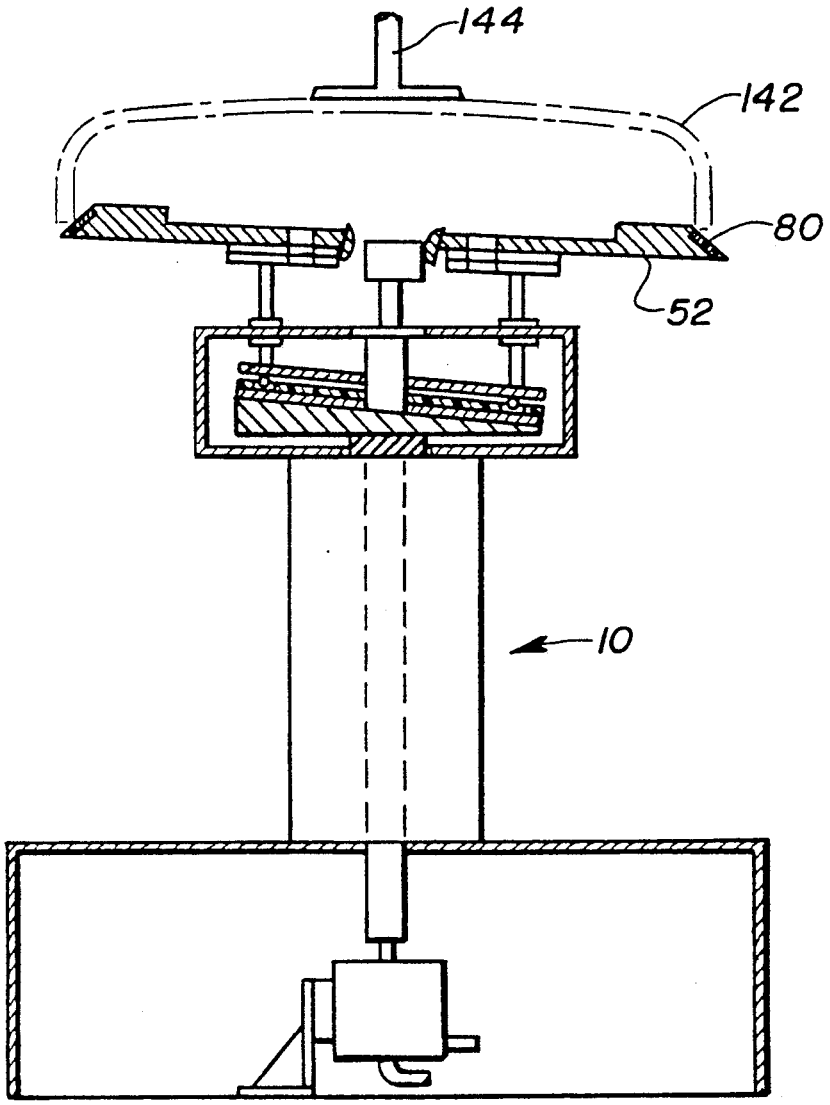
FIG. 5 is a plan view, partially in axial section, of a second embodiment of the novel apparatus.

FIG. 5 shows a second embodiment of the present invention and differs from the prior structure only in that a vacuum chuck assembly is not required since the second embodiment is designed to bevel the inside seal edge of a glass faceplate panel 142, shown in phantom. In this embodiment, the panel 142 is held in contact with the abrasive material 80 of the second plate assembly 52 by an external retainer 144, which is conventional, and may comprise, for example, a vacuum pad or similar support which can be used to pick up and place the workpiece.

What is claimed is:

1. A method for uniformly beveling an inside seal edge of a glass article having an opening at one end thereof, said method including the steps of a) providing a column assembly having an outer housing with a primary rotatable shaft therein, said shaft being attached at one end to a first plate assembly that includes a wobble plate having a first major surface and an oppositely disposed second major surface, said first major surface of said wobble plate being included at an acute angle relative to said second major surface, a wobble plate bearing assembly having a first bearing surface and a second bearing surface being disposed with said second bearing surface contacting said first major surface of said wobble plate, said column assembly further including a second plate assembly spaced from said first plate assembly, said second plate assembly having a bevel plate with a first major surface and an oppositely disposed second major surface, said bevel plate having a central aperture therethrough, said bevel plate having a peripheral shape generally corresponding to that defined by said seal edge of said glass article, said bevel plate having a beveled edge connecting said first and second major surfaces, said beveled edge having abrasive means detachably disposed thereon and projecting above said beveled edge of said bevel plate, a bevel plate bearing assembly having a first bevel plate bearing surface and a second bevel plate bearing surface being disposed with said first bevel plate bearing surface contacting said second major surface of said bevel plate, a secondary rotatable shaft extending through a top surface of said outer housing, said secondary shaft having a proximal end and a distal end, said proximal end being in communication with said first plate assembly and said distal end having an eccentric cam attached thereto, a hub circumscribing said cam, said hub being disposed within said central aperture of said bevel plate to move said second plate assembly orbitally, in a plane normal to the longitudinal axis of said vertical column assembly, said first bearing surface of said wobble plate bearing assembly and said second bearing surface of said bevel plate bearing assembly being in contact with a plurality of vertically movable pins disposed radially around and extending through said top surface of said outer housing to provide a vertical component of motion to said second plate assembly, b) supporting said glass article so that said inside seal edge is in proximity to said beveled edge of said bevel plate, c) establishing contact between said glass article and said abrasive material of said bevel plate, and d) activating said primary rotatable shaft of said column assembly to induce an orbital undulatory motion between said bevel plate and said glass article to abrade at least a portion of said inside seal edge of said glass article.

2. An apparatus for uniformly beveling an inside seal edge of a glass article having an opening at one end thereof, said apparatus comprising a column assembly having a longitudinal axis with a primary rotatable shaft disposed within an outer housing, said shaft being attached to a first plate assembly having a first major surface and an oppositely disposed second major surface, said first major surface being non-parallel to said second major surface, a second plate assembly spaced from said first plate assembly, said second plate assembly having a first major surface and an oppositely disposed second major surface, said first major surface being substantially parallel to said second major surface, said second plate assembly having a peripheral shape generally corresponding to that defined by said seal edge of said glass article, said second plate assembly having a beveled edge extending between said first and second surfaces, said beveled edge containing an abrasive material, a secondary rotatable shaft disposed between said first plate assembly and said second plate assembly, said secondary shaft having a proximal end and a distal end, said proximal end being in communication with said primary rotatable shaft and said distal end engaging a bearing having a cam eccentrically attached thereto which communicates with said second plate assembly and moves said second plate assembly orbitally, in a plane normal to the longitudinal axis of said column assembly, and a plurality of movable pins disposed between and in contact with said first major surface of said first plate assembly and said second major surface of said second plate assembly to provide a component of motion to said second plate assembly which is parallel to the longitudinal axis of column assembly to cause said abrasive material to abrade said inside seal edge.

3. The apparatus as described in claim 2, further including means for locating said glass article against said abrasive material.

4. An apparatus for uniformly beveling an inside edge of a glass funnel for a cathode-ray tube, said funnel having a substantially rectangular opening at one end and a tubular neck at the other end, said apparatus comprising a vertical column assembly having an outer housing with a primary rotatable shaft therein, said shaft being attached at one end to a first plate assembly, said first plate assembly including a wobble plate having a first major surface and an oppositely disposed second major surface, said first major surface being inclined at an acute angle relative to said second major surface, a wobble plate bearing assembly having a first bearing surface and a second bearing surface, said second bearing surface being disposed on said first major surface of said wobble plate, a second plate assembly spaced from said first plate assembly, said second plate assembly including a bevel plate having a first major surface and an oppositely disposed second major surface, said bevel plate having a central aperture therethrough, said bevel plate having a peripheral shape generally corresponding to that defined by said seal edge of said glass funnel, said bevel plate having a beveled edge contiguous with at least said first major surface, abrasive means detachably disposed against and projecting above said beveled edge of said bevel plate to contact and abrade said inside seal edge of said glass funnel, a bevel plate bearing assembly having a first bearing surface and a second bearing surface, said first bearing surface being disposed on said second major surface of said bevel plate; a secondary rotatable shaft extending through a top surface of said outer housing, said secondary shaft having a proximal end and a distal end, said proximal end being in communication with said first plate assembly and said distal end engaging a bearing having a cam eccentrically attached thereto, a hub circumscribing said cam, said hub being disposed within said central aperture of said bevel plate to orbitally move said second plate assembly in a plane normal to the longitudinal axis of said vertical column assembly, a plurality of vertically movable pins disposed radially around and extending through said top surface of said outer housing, said pins being in contact with said first bearing surface of said wobble plate bearing assembly and with said second bearing surface of said bevel plate bearing assembly to provide an undulating motion to said second plate assembly, and securing means attached by biasing means to said top surface of said outer housing, said securing means including at least one resilient seal in contact with an interior surface of said funnel to provide a closure to facilitate attachment of said funnel to said apparatus.

* * * * *